US009695576B2

(12) United States Patent
Worth

(10) Patent No.: US 9,695,576 B2
(45) Date of Patent: Jul. 4, 2017

(54) WEAR ASSEMBLY FOR LOADER BUCKET

(71) Applicant: Caterpillar Inc., Peoria, IL (US)

(72) Inventor: David M. Worth, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 62 days.

(21) Appl. No.: 14/928,218

(22) Filed: Oct. 30, 2015

(65) Prior Publication Data

US 2017/0121947 A1 May 4, 2017

(51) Int. Cl.
*E02F 9/28* (2006.01)
*E02F 3/40* (2006.01)

(52) U.S. Cl.
CPC ..... *E02F 9/2883* (2013.01); *E02F 3/40* (2013.01)

(58) Field of Classification Search
CPC ..... E02F 3/40; E02F 3/8152; E02F 9/2841; E02F 9/2825; E02F 9/2858; E02F 9/2883; E02F 9/2833; Y10T 428/12361; Y10T 428/12389; Y10S 37/903
USPC ..... 37/444, 446, 449, 452–460; 172/701.1–701.3, 719, 772; 296/39.2, 41; 403/378
See application file for complete search history.

(56) References Cited

U.S. PATENT DOCUMENTS 4,129,952 A * 12/1978 Olson ..... B23K 31/025 228/170
4,290,214 A * 9/1981 Stepe ..... E02F 9/2808 172/701.2
5,564,508 A * 10/1996 Renski ..... E02F 9/2883 172/772
7,080,470 B2 7/2006 Jones
7,266,914 B2 * 9/2007 Grant ..... E02F 3/40 37/444
7,275,338 B2 * 10/2007 LaHood ..... E02F 9/2883 37/449
7,712,234 B2 * 5/2010 Striegel ..... E02F 3/40 172/762
D631,490 S * 1/2011 Drager ..... D15/32
8,336,233 B1 * 12/2012 Lombardo ..... E02F 9/2883 172/719
8,877,347 B2 * 11/2014 Dietrich ..... E02F 3/8152 172/772
9,371,631 B2 * 6/2016 Karlsson ..... E02F 9/2825
2003/0066215 A1 4/2003 Grant

FOREIGN PATENT DOCUMENTS

WO 2005045142 5/2005
WO 2015006809 1/2015

* cited by examiner

*Primary Examiner* — Robert Pezzuto

(57) ABSTRACT

A wear assembly for a loader bucket. The wear assembly includes a first side plate coupled to the side wall and a second side plate spaced apart from the first side plate, coupled to the side wall. The wear assembly includes a top plate disposed on the first side plate and the second side plate. Further, the top plate has a first end disposed proximal to the side wall and a second end distal from the side wall. The wear assembly includes a shroud member disposed adjacent to the second end of the top plate and coupled to the first side plate. The wear assembly also includes a wear plate disposed adjacent to the first end of the top plate in front of the shroud member. The wear plate is detachably coupled to an upper surface of the top plate.

20 Claims, 4 Drawing Sheets

WEAR ASSEMBLY FOR LOADER BUCKET

TECHNICAL FIELD

The present disclosure relates to a loader bucket, and more particularly relates to a wear assembly disposed on a side wall of the loader bucket.

BACKGROUND

Machines, such as loaders, dozers, excavators, and the like include a work tool for carrying out various operations. An example of such work tool is a bucket that includes side walls. The side walls of the bucket are subjected to wear during earth moving operations. Also, debris and dirt may block ground engaging members, such as tires or tracks of the machines during the earth moving operations. The buckets are equipped with wing plates coupled by welding or by bolts to the side walls. The wing plates further extend towards opposite ends of the bucket. After a prolonged operation of the machines, the wing plates may wear and hence require frequent replacement or salvaging of the wing plates. This may cause increase maintenance cost of the bucket and further affect productivity of the machine as maintenance of the bucket lead to increase down time of the machine.

WIPO Patent Publication Number 2015/006809 discloses a bucket for an earth moving machine. The bucket includes a generally concave structure having a first and second side walls located adjacent respective opposite lateral ends of the concave structure. The concave structure together with the side walls defines a containment space. The containment space includes a volume of material such as, but not limited to, particulate material such as rocks, sand, aggregate, or any combination thereof. The concave structure has an upper region, at least a portion of which is configured to slope rearward to each side of a vertical mid plane. A rock guard projects over the confinement space from the upper region. The rock guard includes a free lateral edge that slopes or tapers in a reward manner parallel to the upper lip and upper edges.

SUMMARY OF THE DISCLOSURE

In one aspect of the present disclosure, a wear assembly for a loader bucket is provided. The wear assembly includes a first side plate coupled to the side wall and a second side plate spaced apart from the first side plate, and coupled to the side wall. The wear assembly includes a top plate disposed on the first side plate and the second side plate. Further, the top plate has a first end disposed proximal to the side wall and a second end distal from the side wall. The wear assembly includes a shroud member disposed adjacent to the second end of the top plate and coupled to first side plate. Further, the shroud member is configured to cover at least a portion of the top plate and the first side plate. The wear assembly also includes a wear plate disposed adjacent to the first end of the top plate in front of the shroud member. The wear plate is detachably coupled to an upper surface of the top plate.

In another aspect of the present disclosure, a loader bucket is provided. The loader bucket includes a base portion having a cutting edge assembly. The loader bucket includes one or more side walls coupled to the base portion. Further, the base portion and the one or more side walls are together configured to carry a material. The loader bucket includes a wear assembly disposed on the one or more side walls. The wear assembly includes a first side plate coupled to the one or more side walls and a second side plate spaced apart from the first side plate, coupled to the one or more side walls. The wear assembly includes a top plate disposed on the first side plate and the second side plate. The top plate has a first end disposed proximal to the one or more side walls and a second end distal from the one or more side walls. The wear assembly also includes a shroud member disposed adjacent to the second end of the top plate and coupled to the first side plate. Further, the shroud member is configured to cover at least a portion of the top plate and the first side plate. The wear assembly includes a wear plate disposed adjacent to the first end of the top plate in front of the shroud member. The wear plate is detachably coupled to an upper surface of the top plate.

In yet another aspect of the present disclosure, a wear assembly disposed on a side wall of a loader bucket is provided. The wear assembly includes a first side plate coupled to the side wall and a second side plate spaced apart from the first side plate, and coupled to the side wall. The wear assembly includes a top plate disposed on the first side plate and the second side plate. Further, the top plate has a first end disposed proximal to the side wall and a second end distal from the side wall. The wear assembly includes a wear plate disposed on an upper surface of the top plate. Further, the wear plate is detachably coupled to the top plate. The wear assembly further includes a pair of shroud members disposed adjacent to the second end of the top plate behind the wear plate, and coupled to the first side plate and the second side plate. The wear assembly also includes a plurality of wear strips disposed on the upper surface of the top plate and an outer surface of the side wall around the wear plate.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
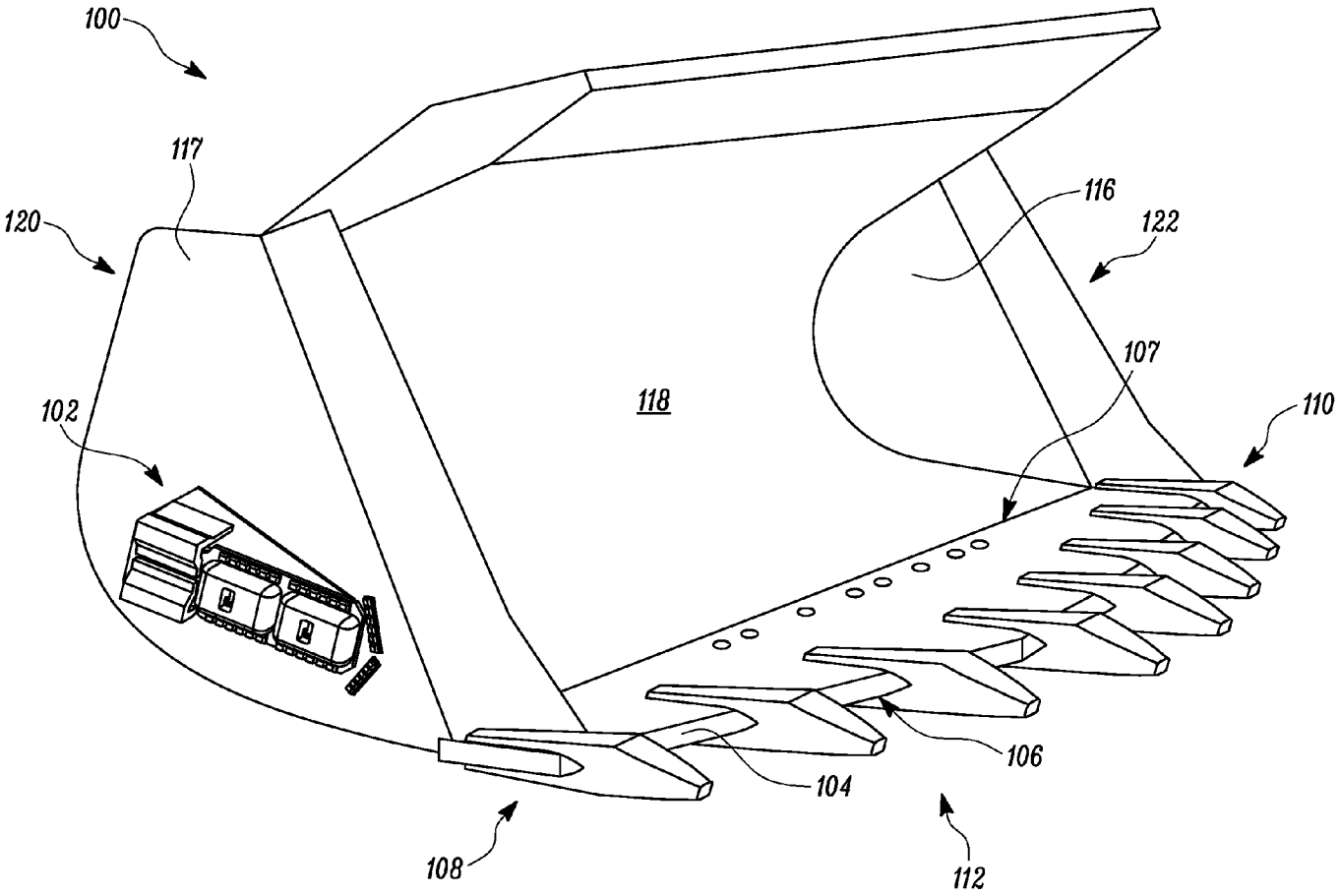
FIG. 1 is a perspective view of a loader bucket and a wear assembly disposed on a side wall of the loader bucket, according to an embodiment of the present disclosure.

FIG. 1 illustrates a perspective view of a loader bucket 100 having a wear assembly 102. In the illustrated embodiment, the loader bucket 100 may be associated with machines, such as a wheel loader or a track loader. In various embodiments, the wear assembly 102 may be associated with a work tool, such as a bucket, a blade and a dipper of the machines, such as a dozer, an excavator, or any other machine having the work tool used for excavation. The loader bucket 100 may be used for performing earth moving operations, such as for excavation, and for loading and unloading earthen material. The loader bucket 100 may be pivotally attached to a frame of the machine adjacent to a front end and/or a rear end thereof.

The loader bucket 100 includes a base portion 104. The base portion 104 includes a leading edge 106 and a trailing edge 107. The leading edge 106 and the trailing edge 107 extend between a first end 108 and a second end 110 of the base portion 104. The base portion 104 includes a plurality of teeth 112 for engaging with a work surface.

In the illustrated embodiment, the loader bucket 100 includes a pair of side walls. Each of the pair of side walls is hereinafter referred to as a first side wall 120 and a second side wall 122. The first and second side walls 120, 122 are disposed at the first and second ends 108, 110, respectively, of the base portion 104. Each of the first and the second side walls 120, 122 includes an inner surface 116 and an outer surface 117. The loader bucket 100 includes a longitudinal wall 118 connecting to the trailing edge 107 of the base portion 104. Further, the longitudinal wall 118 is connected to the inner surface 116 of the first and second side walls 120, 122 as shown. The base portion 104, the first side wall 120, the second side wall 122 and the longitudinal wall 118 are together configured to carry the earthen material. The wear assembly 102 is disposed on the outer surface 117 of each of the first and second side walls 120, 122. The wear assembly 102 is configured to deflect the earthen materials, such as rocks and other hard materials from wheels or tracks of the machine while carrying out operations, such as excavation, quarrying, and the like. For illustration purpose, the wear assembly 102 disposed on the outer surface 117 of the first side wall 120 is shown.

Figure 2:
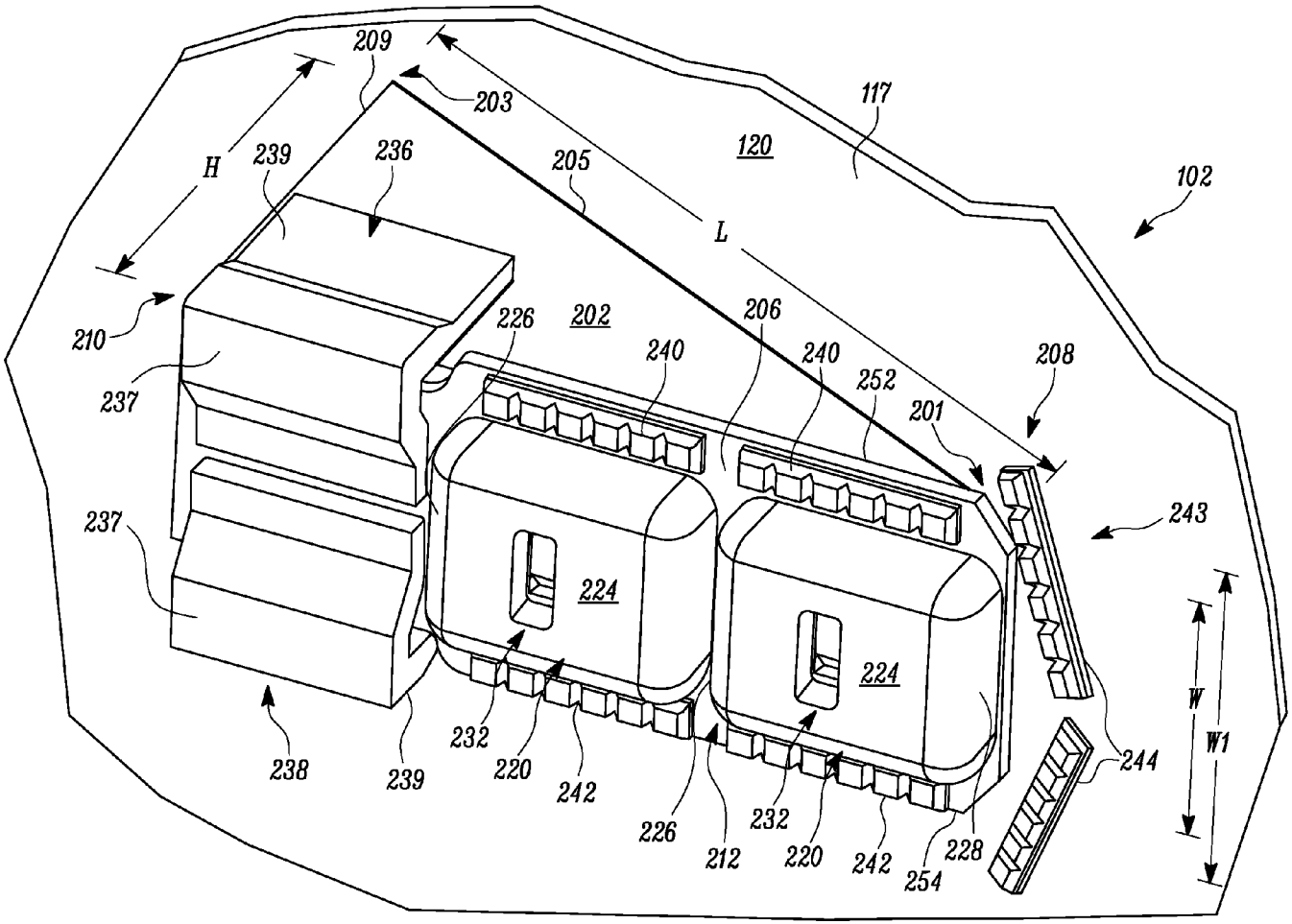
FIG. 2 is a perspective view of the wear assembly disposed on the side wall, according to an embodiment of the present disclosure.
Figure 3:
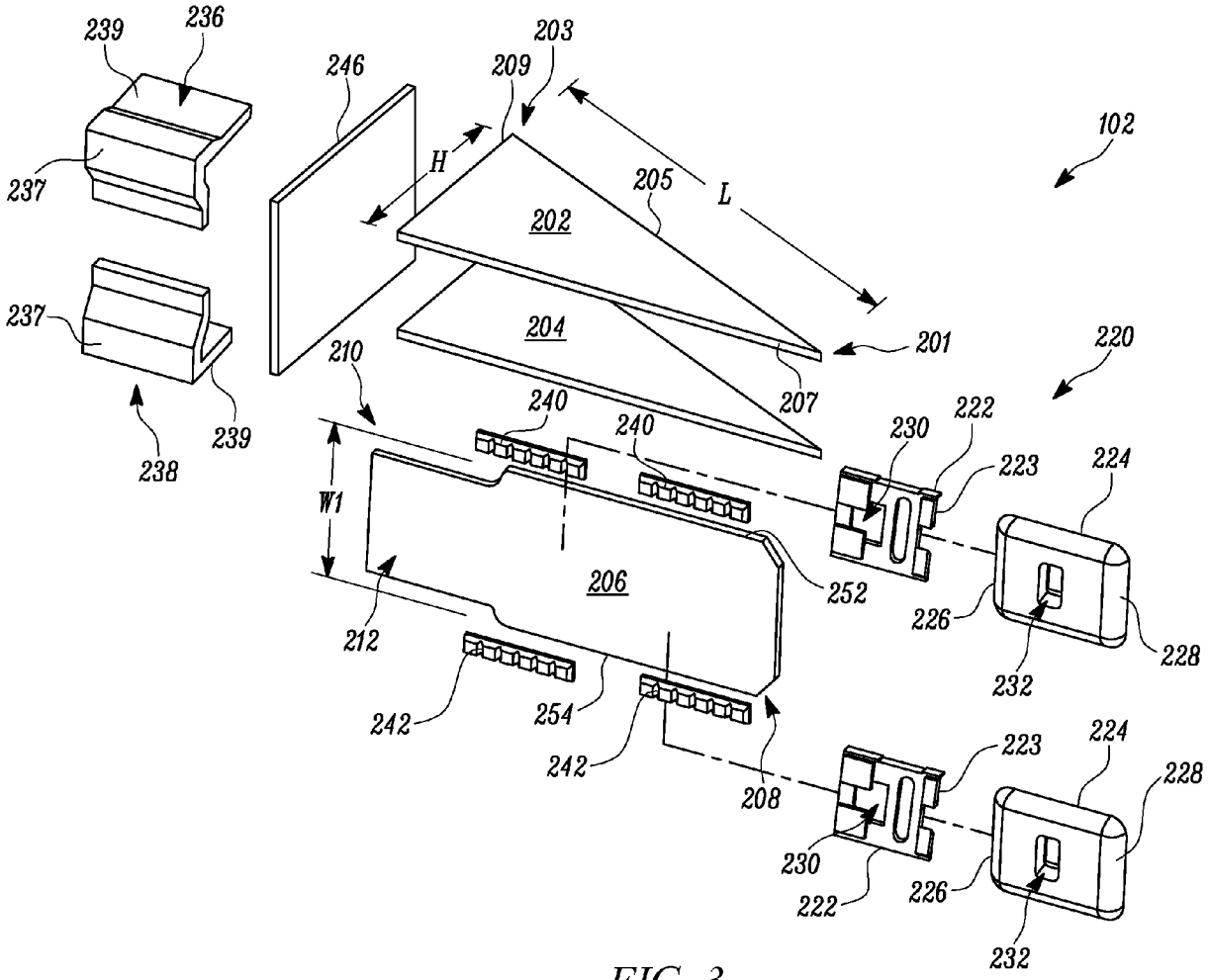
FIG. 3 is an exploded view of the wear assembly, according to an embodiment of the present disclosure.
Figure 4:
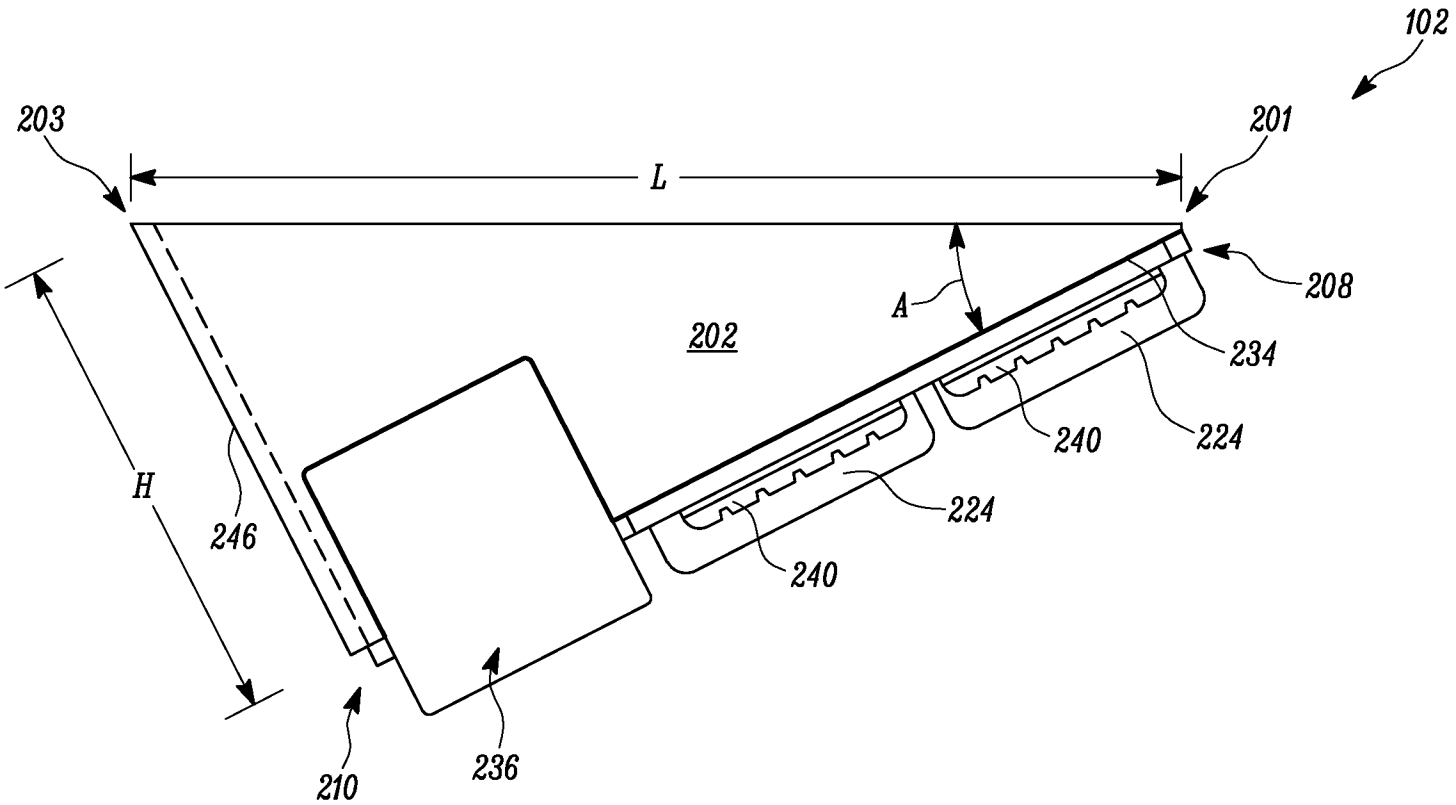
FIG. 4 is a top view of the wear assembly, according to an embodiment of the present disclosure.

FIG. 2 illustrates a perspective view of the wear assembly 102 disposed on the first side wall 120, according to an embodiment of the present disclosure. The wear assembly 102 is disposed on the outer surface 117 of the first side wall 120. Referring to FIGS. 2 to 4, the wear assembly 102 includes a first side plate 202 and a second side plate 204 spaced apart from the first side plate 202. Each of the first and second side plates 202, 204 includes a first edge 205, a second edge 207 and a third edge 209. The first edge 205 of the first and second side plates 202, 204 is fixedly coupled to the first side wall 120. In the illustrated embodiment, the first edge 205 of the first and second side plates 202, 204 is welded to the outer surface 117 of the first side wall 120. In other embodiments, the first edge 205 of the first and second side plates 202, 204 may be coupled to the first side wall 120 using known coupling methods, such as fastening by bolts and nuts.

Each of the first and second side plates 202, 204 has a first end 201 and a second end 203 distal to the first end 201. Each of the first and second side plates 202, 204 may define a length 1' extending between the first end 201 and the second end 203. The length 1' of the first and second side plates 202, 204 are hereinafter referred to as the length 1' of the wear assembly 102. Similarly, the second side plate 204 may be spaced apart form the first side plate 202 such that the first and second side plate 202, 204 may define a width 'W' (shown in FIG. 2) for the wear assembly 102. In an example, a ratio of the length 1' of the wear assembly 102 to the width 'W' of the wear assembly 102 is in a range between 2.0 and 3.0. The second edge 207 of the first and second side plates 202, 204 is opposite to the first edge 205. The second edge 207 is proximal to the first edge 205 adjacent to the first end 201 of the first and second side plates 202, 204. Further, the second edge 207 is away from the first edge 205 adjacent to the second end 203 of the first and second side plates 202, 204. Thus the first and second side plates 202, 204 define a height 'H' (shown in FIG. 2) at the second end 203 of the first and second side plates 202, 204. Furthermore, a slope is defined on the first and second side plates 202, 204 along the length 1' of the wear assembly 102. Such that, a ratio of the length 1' of the wear assembly 102 to the height 'H' of the wear assembly 102 is in a range between 2.0 and 3.0. The third edge 209 of the first and second side plates 202, 204 is adjacent to the second end 203 of the first and second side plates 202, 204.

The wear assembly 102 includes a top plate 206 disposed on the first side plate 202 and the second side plate 204. The top plate 206 includes a lower surface 234 (shown in FIG. 4) and an upper surface 212. The lower surface 234 of the top plate 206 is fixedly coupled to the second edge 207 of the first and second side plates 202, 204. In the illustrated embodiment, the lower surface 234 of the top plate 206 is welded to the second edge 207 of the first and second side plates 202, 204. In other embodiments, the lower surface 234 of the top plate 206 may be fastened to the second edge 207 of the first and second side plates 202, 204 by bolts and nuts or any other fastening methods known in the art.

Further, the top plate 206 includes a first end 208 and a second end 210. The first end 208 of the top plate 206 is disposed proximal to the first side wall 120 and the second end 210 of the top plate 206 is distal to the first side wall 120. Specifically, the first end 208 and the second end 210 of the top plate 206 is coupled to the first and second side plates 202, 204 adjacent to the first end 201 and the second end 203, respectively, of the first and second side plates 202, 204. The top plate 206 further includes a first side end 252 and a second side end 254. In the illustrated embodiment, a width 'W1' of the top plate 206, defined between the first side end 252 and the second side end 254, is greater than the width 'W' defined between the first side plate 202 and the second side plate 204. Such that a portion of the top plate 206 adjacent to the first side end 252 and the second side end 254 extends beyond the first side wall 120 and the second side wall 122 respectively. Furthermore, the top plate 206 is welded to the first and second side walls 120, 122 by providing a weld seam (shown in FIG. 4) between the lower surface 234 of the top plate 206 and the first and second side walls 120, 122. In an alternate embodiment, the width 'W1' of the top plate 206 may be equal to the width 'W' of the wear assembly 102. The top plate 206 is disposed at an angle of inclination 'A' with respect to the outer surface 117 of the first side wall 120. In an example, the angle of inclination 'A' of the top plate 206 with respect to the outer surface 117 of the first side wall 120 is in a range between 20 to 40 degrees. In various examples, the angle of inclination 'A' of the top plate 206 with respect to outer surface 117 of the first side wall 120 may differ based on various parameters including, but not limited to, a width of the machine defined by the wheels or the tracks.

The wear assembly 102 further includes a cover assembly 220 disposed adjacent to the first end 208 of the top plate 206. Specifically, the cover assembly 220 is detachably coupled to the upper surface 212 of the top plate 206. In the illustrated embodiment, the cover assembly 220 includes a coupling member 222 and a wear plate 224. In one embodiment, the coupling member 222 is fixedly coupled to the upper surface 212 of the top plate 206 by a welding technique. In other embodiments, the coupling member 222 may be coupled to the upper surface 212 of the top plate 206 by fasteners, such as bolts and nuts or any other coupling methods known in the art. The coupling member 222 includes a receiving end 223 that is configured to be slidably coupled to the wear plate 224. The wear plate 224 may be embodied as a plate having a first end 226 and a second end 228. The first end 226 of the wear plate 224 is configured to be disposed adjacent to the second end 210 of the top plate 206. The second end 228 of the wear plate 224 is configured to be disposed adjacent to the first end 208 of the top plate 206. Referring to FIG. 1, a pair of the cover assembly 220 is disposed on the top plate 206.

The wear plate 224 may be slidably coupled to the coupling member 222 by pushing the first end 226 of the wear plate 224 from the receiving end 223 of the coupling member 222 towards the second end 210 of the top plate 206. In an exemplary embodiment, the coupling member 222 may include an opening 230. Similarly, the wear plate 224 may include an opening 232. The opening 232 of the wear plate 224 may align with the opening 230 of the coupling member 222, when the coupling member 222 and the wear plate 224 are slidably coupled. The opening 230 of the coupling member 222 and the opening 232 of the wear plate 224 are configured to receive a fastening member (not shown). The fastening member may be a compression retainer. The compression retainer, in free length thereof, may retain the wear plate 224 with the coupling member 222 in an engaged position thereof. For disengaging the wear plate 224 from the coupling member 222, the compression retainer may be compressed to a length shorter than the free length.

The wear assembly 102 further includes a shroud member 236 configured to cover at least a portion of the top plate 206 and a portion of the first side plate 202. The shroud member 236 is hereinafter referred to as 'the first shroud member 236'. Similarly, the wear assembly 102 further includes an additional shroud member 238 configured to cover at least a portion of the top plate 206 and a portion of the second side plate 204. The additional shroud member 238 is hereinafter referred to as 'the second shroud member 238'. Each of the first and second shroud members 236, 238 includes a first flange portion 237 and a second flange portion 239 extending perpendicular to the first flange portion 237. The first shroud member 236 is disposed adjacent to the second end 210 of the top plate 206, such that the first flange portion 237 is coupled to the top plate 206 and the second flange portion 239 is coupled to the first side plate 202 by a welding technique. Similarly, the second shroud member 238 is disposed adjacent to the second end 210 of the top plate 206, such that the first flange portion 237 is coupled to the top plate 206 and the second flange portion 239 is coupled to the second side plate 204 by a welding technique. The wear plate 224 is disposed on the top plate 202 in front of the first and second shroud members 236, 238. In other embodiments, the first and second shroud members 236, 238 may be coupled to the top plate 206 and the first and second side plates 202, 204, respectively, using fastening members, such as bolts and nuts, or any other known fastening methods. Additional shroud members may be optionally coupled to the top plate 206 and the first and second side plates 202, 204 apart from the first and second shroud members 236, 238.

The wear assembly 102 further includes a plurality of wear strips 243 disposed on the upper surface 212 of the top plate 206 and the outer surface 117 of the first side wall 120 around the wear plate 224. In the present embodiment, the plurality of wear strips 243 is fixedly coupled to the top plate 206 and the first side wall 120 by a welding technique. Alternately, the plurality of wear strips 243 may be removably coupled to the top plate 206 and the first side wall 120 by fastening members, such as screws, adhesives, bolts and the like. In an embodiment, the plurality of wear strips 243 includes a first wear strip 240, a second wear strip 242, and a third wear strip 244. The first wear strip 240 is disposed adjacent to the first side end 252 of the top plate 206. The second wear strip 242 is disposed adjacent to the second side end 254 of the top plate 206. The third wear strip 244 is disposed on the outer surface 117 of the side wall adjacent to the first end 201 of the top plate 206. Referring to FIGS. 1 to 4, a pair of the first wear strips 240 and the second wear strips 242 are disposed adjacent to the first side end 252 and the second side end 254, respectively, of the top plate 206. Further, a pair of the third wear strips 244 is disposed adjacent to the first end 208 of the top plate 206. The plurality of wear strips 243 may be made of material having hardness higher than a hardness of material of other components of the wear assembly 102. Each of the plurality of wear strips 243 may be an elongated straight wear strips, or may have any other shape known in the art.

The wear assembly 102 further includes a rear plate 246 disposed adjacent to the second end 210 of the top plate 206. The rear plate 246 is configured to enclose a hollow space (not shown) defined between the first side plate 202, the second side plate 204 and the top plate 206. In the illustrated embodiment, the rear plate 246 is welded to the top plate 206, the first side plate 202 and the second side plate 204. In other embodiments, the rear plate 246 may be coupled to the top plate 206, the first side plate 202 and the second side plate 204 by fastening members, such as bolts or any other coupling method known in the art.

INDUSTRIAL APPLICABILITY

The wear assembly 102 of the present disclosure is configured to deflect the earth or debris away from the wheels or the tracks of the machine employed for earth moving operations. The wear assembly 102 includes the cover assembly 220 that protects the top plate 206 of the wear assembly 102 from directly contacting earthen material, such as earth or debris. The cover assembly 220 includes the wear plates 224 that can be replaced thereby reducing the downtime of the loader bucket 100. The first and second wear strips 240, 242 protects the wear plate 224 from wearing at the first side ends 252 and second side ends 254 respectively by minimizing the direct contact of earth or debris during earth moving operations. The third wear strip 244 protects the wear plate 224 from the first end 206 during earth moving operations by directly contacting the earth or debris. The width "W1" of the top plate 206 covers the weld seam between the lower surface 234 of the top plate 206 and the second edge 207 thereby prevents the weld seam from damage due to direct contact with earth or debris during earth moving operations. The rear plate 246 disposed on the third edge 209 protects the hollow space from deposition of debris during earth moving operations. The top plate 206 inclines away at the angle of inclination "A" from the outer surface 117 of the first side wall 120 deflects the earth or debris away from the loader bucket 100 during earth moving operations. The shroud members 236, 238 prevent shearing of the top plate 206 from the first and second side plates 202, 204. Also the shroud members 236, 238 prevent the direct contact of the wear assembly 102, improving the work life of the wear assembly 102.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A wear assembly disposed on a side wall of a loader bucket, the wear assembly comprising:

a first side plate coupled to the side wall;

a second side plate spaced apart from the first side plate, and coupled to the side wall;

a top plate disposed on the first side plate and the second side plate, wherein the top plate has a first end disposed proximal to the side wall and a second end distal from the side wall;

a shroud member disposed adjacent to the second end of the top plate and coupled to the first side plate, wherein the shroud member is configured to cover at least a portion of the top plate and the first side plate; and a wear plate disposed adjacent to the first end of the top plate in front of the shroud member, wherein the wear plate is detachably coupled to an upper surface of the top plate.

2. The wear assembly of claim 1 comprising an additional shroud member disposed adjacent to the second end of the top plate, and coupled to the second side plate.

3. The wear assembly of claim 1 comprising a plurality of wear strips disposed on the upper surface of the top plate and an outer surface of the side wall around the wear plate.

4. The wear assembly of claim 3, wherein the plurality of wear strips comprises:

a first wear strip disposed adjacent to a first side end of the top plate along a length of the top plate defined between the first end and the second end;

a second wear strip disposed adjacent to a second side end of the top plate along the length of the top plate; and a third wear strip disposed on the outer surface of the side wall adjacent to the first end of the top plate.

5. The wear assembly of claim 1 comprising a cover assembly disposed adjacent to the first end of the top plate, wherein the cover assembly comprises a coupling member attached to the upper surface of the top plate, and wherein the wear plate is removably coupled to the coupling member.

6. The wear assembly of claim 1, wherein the top plate has a width greater than a width defined between the first side plate and the second side plate.

7. The wear assembly of claim 1 comprising a rear plate disposed adjacent to the second end of the top plate, the rear plate configured to enclose a hollow space defined between the first side plate, the second side plate and the top plate.

8. The wear assembly of claim 1, wherein an angle of inclination of the upper surface of the top plate with respect to the outer surface of the side wall is in a range between 20 and 40 degree.

9. The wear assembly of claim 1, wherein a ratio of a length of the wear assembly to a width of the wear assembly is in a range between 2.0 and 3.0.

10. The wear assembly of claim 1, wherein a ratio of a length of the wear assembly to a height of the wear assembly is in a range between 2.0 and 3.0.

11. A loader bucket comprising:

a base portion having a cutting edge assembly;

one or more side walls coupled to the base portion, wherein the base portion and the one or more side walls are together configured to carry a material; and a wear assembly disposed on the one or more side walls, the wear assembly comprising:

a first side plate coupled to the one or more side walls;

a second side plate spaced apart from the first side plate, and coupled to the one or more side walls;

a top plate disposed on the first side plate and the second side plate, wherein the top plate has a first end disposed proximal to the one or more side walls and a second end distal from the one or more side walls;

a shroud member disposed adjacent to the second end of the top plate and coupled to the first side plate, wherein the shroud member is configured to cover at least a portion of the top plate and the first side plate; and a wear plate disposed adjacent to the first end of the top plate in front of the shroud member, wherein the wear plate is coupled to an upper surface of the top plate.

12. The loader bucket of claim 11 comprising an additional shroud member disposed adjacent to the second end of the top plate, and coupled to the second side plate.

13. The loader bucket of claim 11 comprising a plurality of wear strips disposed on the upper surface of the top plate and an outer surface of the side wall around the wear plate.

14. The loader bucket of claim 13, wherein the plurality of wear strips comprises:

a first wear strip disposed adjacent to a first side end of the top plate along a length of the top plate defined between the first end and the second end;

a second wear strip disposed adjacent to a second side end of the top plate along the length of the top plate defined between the first end and the second end; and a third wear strip disposed on the outer surface of the side wall adjacent to the first end of the top plate.

15. The loader bucket of claim 11, wherein the wear assembly comprising a cover assembly disposed adjacent to the first end of the top plate, wherein the cover assembly comprises a coupling member attached to the upper surface of the top plate, and wherein the wear plate is removably coupled to the coupling member.

16. The loader bucket of claim 11, wherein the top plate has a width greater than a width defined between the first side plate and the second side plate.

17. The loader bucket of claim 11, wherein an angle of inclination of the upper surface of the top plate with respect to the outer surface of the side wall is in a range between 20 and 40 degree.

18. The loader bucket of claim 11, wherein a ratio of a length of the wear assembly to a width of the wear assembly is in a range between 2.0 and 3.0.

19. The loader bucket of claim 11, wherein a ratio of a length of the wear assembly to a height of the wear assembly is in a range between 2.0 and 3.0.

20. A wear assembly disposed on a side wall of a loader bucket, the wear assembly comprising:

a first side plate coupled to the side wall;

a second side plate spaced apart from the first side plate, and coupled to the side wall;

a top plate disposed on the first side plate and the second side plate, wherein the top plate has a first end disposed proximal to the side wall and a second end distal from the side wall;

a wear plate disposed on an upper surface of the top plate, wherein the wear plate is detachably coupled to the top plate;

a pair of shroud members disposed adjacent to the second end of the top plate behind the wear plate, and coupled to the first side plate and the second side plate; and a plurality of wear strips disposed on the upper surface of the top plate and an outer surface of the side wall around the wear plate.

* * * * *